United States Patent [19]

Ueda

[11] Patent Number: 4,833,304

[45] Date of Patent: May 23, 1989

[54] AUTOMATIC HEATING APPLIANCE WITH FOOD IDENTIFYING FUNCTION

[75] Inventor: Shigeki Ueda, Yamatokoriyama, Japan

[73] Assignee: Matsushita Electric Industrial Co., Ltd., Japan

[21] Appl. No.: 133,789

[22] Filed: Dec. 16, 1987

[30] Foreign Application Priority Data

Dec. 17, 1986 [JP] Japan ..... 61-300969
Dec. 17, 1986 [JP] Japan ..... 61-300970

[51] Int. Cl.[4] ..... H05B 1/02

[52] U.S. Cl. ..... 219/518; 219/10.55 B; 99/325; 340/686

[58] Field of Search ..... 219/10.55 B, 10.55 F, 219/10.55 R, 10.55 E, 518, 482, 490; 340/686; 99/325, DIG. 14, 451; 73/627

[56] References Cited

U.S. PATENT DOCUMENTS 4,157,464 6/1979 Smith et al. ..... 219/10.55 F X
4,278,866 7/1981 Nevins et al. ..... 73/627 X
4,329,557 5/1982 Staats ..... 219/10.55 F
4,357,513 11/1982 Kawata et al. ..... 219/10.55 B
4,434,341 2/1984 Busby ..... 219/10.55 F X
4,456,806 6/1984 Arimatsu ..... 219/10.55 F X
4,488,026 12/1984 Tanabe ..... 219/10.55 B
4,591,684 5/1986 Tanabe et al. ..... 219/10.55 R X
4,596,914 6/1986 Morino ..... 219/10.55 E X

OTHER PUBLICATIONS

"Ultrasonic Ceramic Microphones and their Applications" by Kozo Kawasaki et al; National Technical Report, vol. 29, No 3 (Jun. 1983) pp. 140–150.

*Primary Examiner*—Philip H. Leung
*Attorney, Agent, or Firm*—Lowe, Price, LeBlanc, Becker & Shur

[57] ABSTRACT

A heating appliance for heating an object within a heating chamber. In the heating chamber are formed rack rails on which a table is located and a heater. The rack rails are stepwise arranged so as to allow the table to take a desired position corresponding to the kind of an object to be heated. The heating applicance includes a distance-measuring sensor for measuring a distance to the table means or the object. A control unit, may comprising a known microcomputer, controls the heater on the basis of the distance measured by the sensor so as to appropriately heat the object in accordance with its kind.

14 Claims, 5 Drawing Sheets

AUTOMATIC HEATING APPLIANCE WITH FOOD IDENTIFYING FUNCTION

BACKGROUND OF THE INVENTION

The present invention relates generally to automatic heating appliances, and more particularly to such an automatic heating appliance for controlling the heating temperature of an object in accordance with the kind of the object. The present invention is applicable particularly, but not exclusively, to an oven for cooking a food.

Known are heating appliances such as electric oven and gas oven for heating an object with elevation of the temperature of air within a heating chamber and convection of the heated air. Such a heating appliance generally has a plurality of keys on an operating pannel, which are operated in accordance with the kind, class or nature, of the object to be heated within the heating chamber because the cooking time period and heating temperature are respectively different in accordance with the class or nature of the object. The cooking time period and the heating temperature are respectively selected by different keys and one of a plurality of racks provided within the heating chamber is selected in accordance with the class of the object to be heated so as to obtain a desired heat distribution. The selection of the keys is troublesome for users and an error in selection of the correct rack causes failure of cooking of the object. As a result improvement is desirable from the viewpoint of simplification of handling the appliance and prevention of the cooking failure.

SUMMARY OF THE INVENTION

The present invention has been developed in order to eliminate the above-mentioned drawbacks inherent to the conventional heating appliances.

It is therefore an object of the present invention to provide a new and improved automatic heating appliance which is capable of automatically and appropriately controlling the heating temperature by determining the kind or nature of the object to be heated.

A feature of an automatic heating appliance according to the present invention is to detect the class of an object to be heated on the basis of the position of the object within a heating chamber or state of gas generated from the object in response to heating and automatically control the heating temperature of the object in accordance with the class of the object, resulting in reduction of the number of operating keys for cooking instruction and simplification of operation of the appliance.

In accordance with the present invention, there is provided a heating appliance with a heating chamber, comprising: heating means for heating an object which is encased within the heating chamber; table means provided within the heating chamber, the object being placed on the table means; rack means within the heating chamber so that the table means is held at a desired position; sensor means for measuring a distance to the table means or the object; and control means for controlling the heating means on the basis of the distance measured by the sensor means.

In accordance with the present invention, there is further provided a heating appliance with a heating chamber, comprising: heating means for heating an object which is encased within the heating chamber; table means provided within the heating chamber, the object being placed on table means; rack means including pairs of supporting rails within the heating chamber so that the table means is held at a desired position; first sensor means for measuring a distance to the table means or the object; second sensor means for sensing a vapor and/or gas generated from the object; and control means for controlling the heating means on the basis of the distance measured by the sensor means and the generation state of the gas sensed by the second sensor means.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
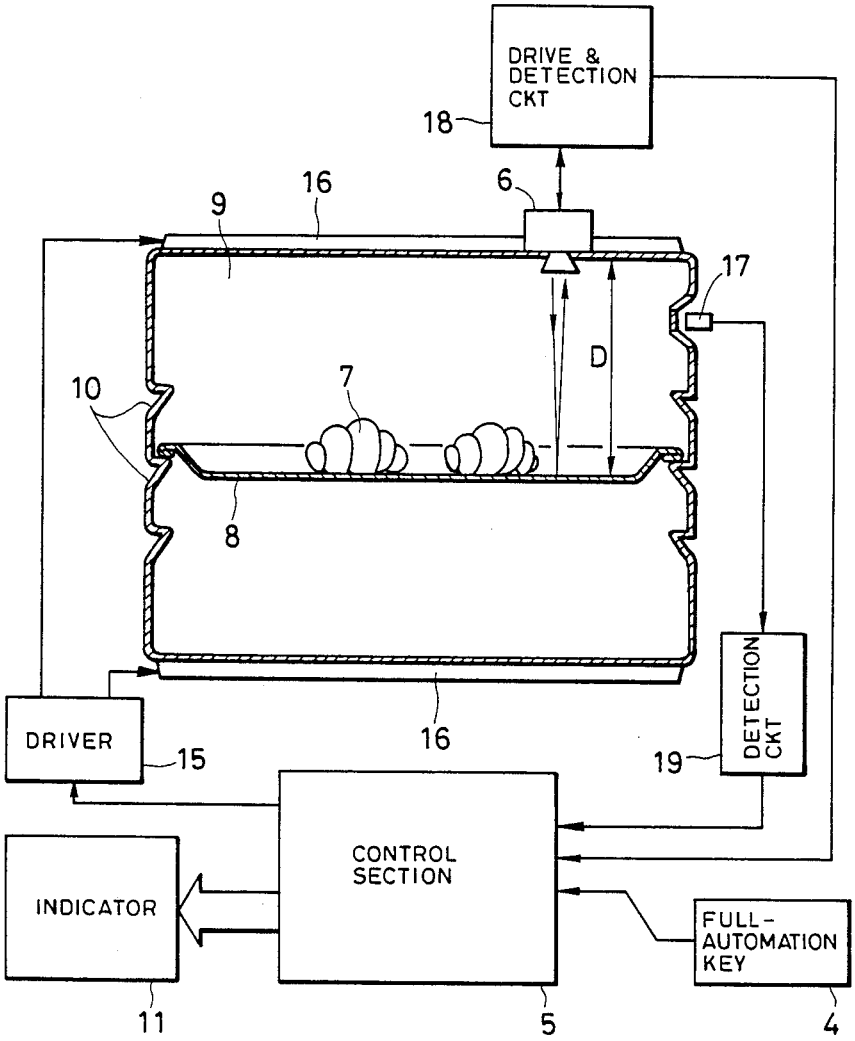
FIG. 1 is a block diagram showing an arrangement of an automatic heating appliance according to a first embodiment of the present invention.
Figure 2:
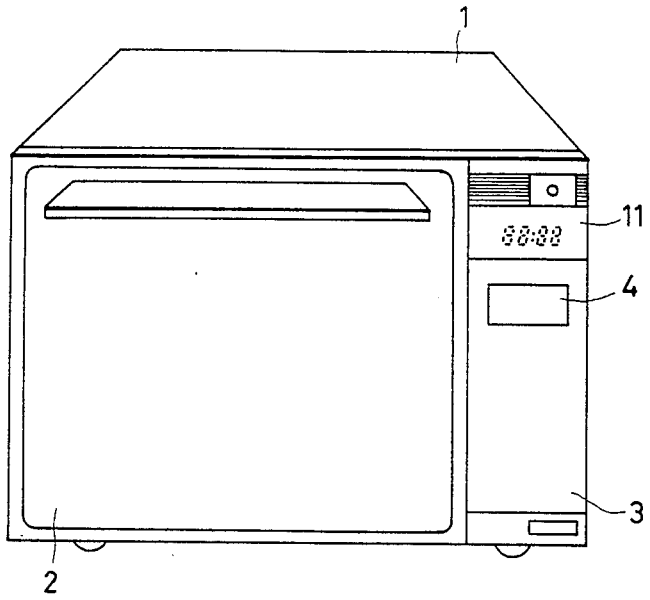
FIG. 2 is a perspective view showing the external form of the automatic heating appliance according to the invention.
Figure 3:
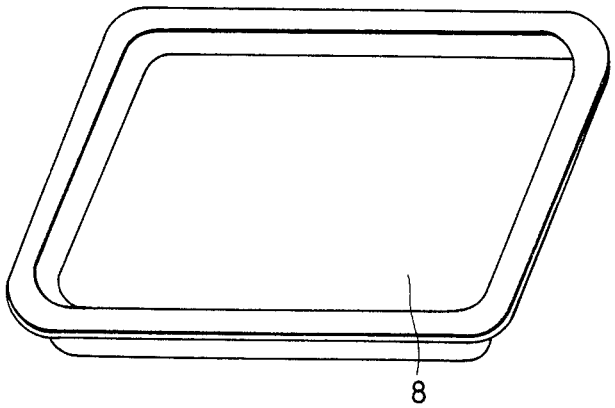
FIG. 3 is a perspective view illustrating a table on which an object to be heated is placed.
Figure 4:
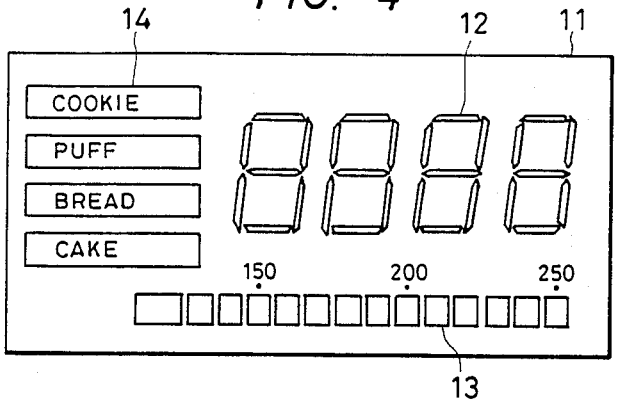
FIG. 4 is an illustration of an indicator of the automatic heating appliance of the invention.

Referring now to FIG. 1, there is illustrated an arrangement of an automatic heating appliance according to an embodiment of the present invention. In FIG. 1, heating instruction is transmitted to a control section 5 through a full-automation key board 4. The keyboard 4 is mounted on an operating panel 3 which is illustrated in FIG. 2 in a perspective view showing the external appearance of the automatic heating appliance. Numerals 1 and 2 represent a housing and a door of the appliance, respectively. In response to the heating instruction, the control section 5, which may comprise a known microcomputer with a central processing unit (CPU) and memories, energizes a distance-measuring sensor 6 through a drive and detection circuit 18 so as to measure the distance D to a table 8 on which an object 7 is placed, the distance-measuring sensor being provided on the ceiling of a heating chamber 9. Provided within the heating chamber 9 are stepwise pairs of rack rails 10, one pair of which is selected in accordance with the class of the object 7. For example, the upper rack rails 10 are used for cooking of a cookie, the middle rack rails 10 are used for cooking of a bread and a chou, and the lower rack rails 10 are used for cooking of a cake. The desired position may be determined in accordance with the arrangement of the heating chamber 9, i.e., heat distribution and so on. The distance-measuring sensor 6 measures the distance D to the table 8 and this distance measurement allows detection of the position of the table 8, which may be arranged as illustrated in FIG. 3 such that its flange-portions are placed on the pair of the rack rails 10. The detection of the position of the table 8 further allows estimation of the kind of the object 7. The result of the estimation is indicated on a display section 11 as shown in FIG. 4, the display section 12 comprising a class-indicating portion 14 and further time-indicating portion 12 and temperature-indicating portion 13. The indication of the class of the object 7 to be heated allows confirmation of the class of the object 7 by the user. After the indication, the control section 5 enerzises upper and lower heaters 16 through a driver 15 so as to obtain a heating temperature corresponding to the class of the object 7 specified by the user. The heaters 16 may be of the electric type or gas type. The temperature within the heating chamber 9 is sensed by means of a temperature sensor 17 and the sensed temperature information is supplied through a detection circuit 19 with an analog-to-digital converter to the control section 5 which in turn controls the power supply to the heaters 16, i.e., distribution of the power supply to the upper and lower heaters 16 and the heating time, in accordance with the appointed object class.

Figure 5:
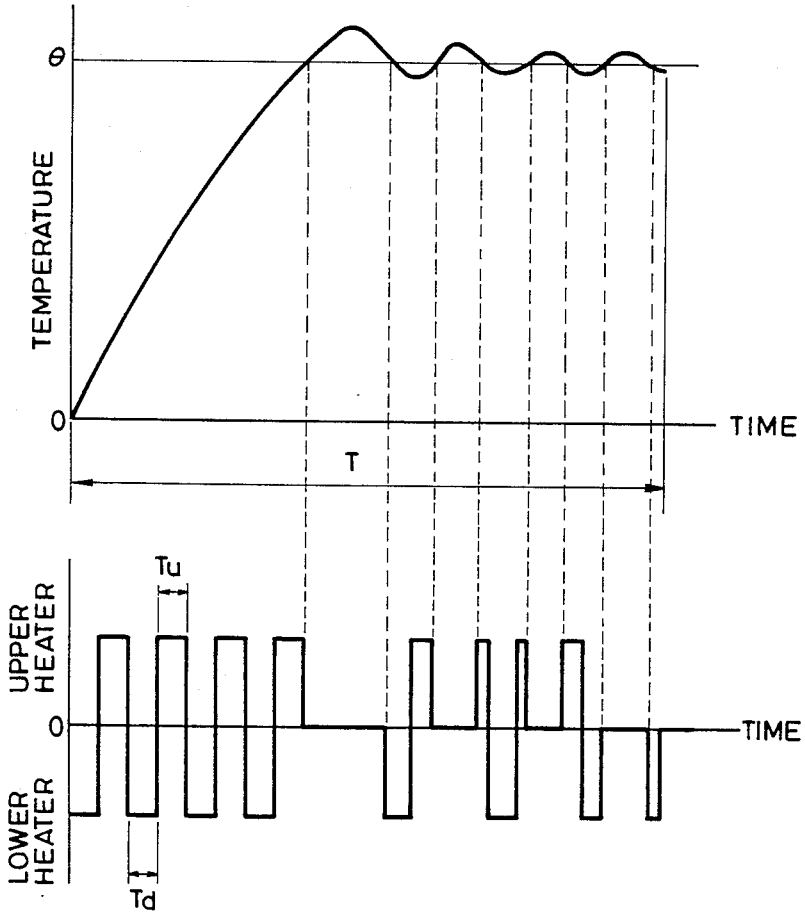
FIG. 5 is a graphic diagram for describing a heating temperature control method of the invention.

FIG. 5 is a time chart illustrating one example of methods of power supply to the upper and lower heaters 16 and controlled temperature obtained as the result of the power supply. As understood from FIG. 5, the temperature is controllable by control of the energizing time period Tu to the upper heater 16 and the energizing time period Td to the lower heater 16. For example, the heating temperature is controlled to 160° C. when the object 7 is a cookie and to 180° C. when it is a puff. Furthermore, the overall heating time period T is determined in accordance with the class of the object 7. For example, the time period T is set to 15 minutes when it is a cookie and to 25 minutes when it is a puff.

Figure 6:
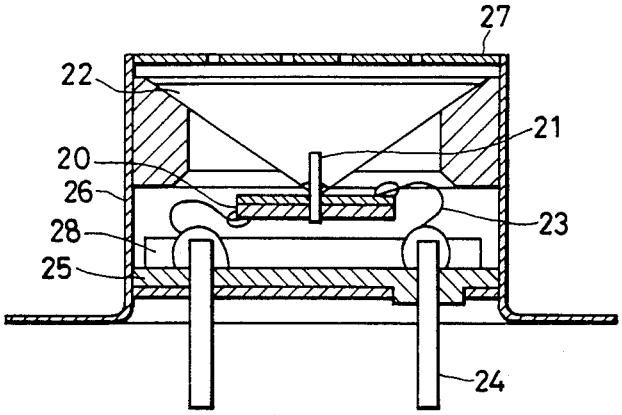
FIG. 6 is a cross-sectional view showing an ultrasonic sensor used in the automatic heating appliance of the invention.
Figure 7:
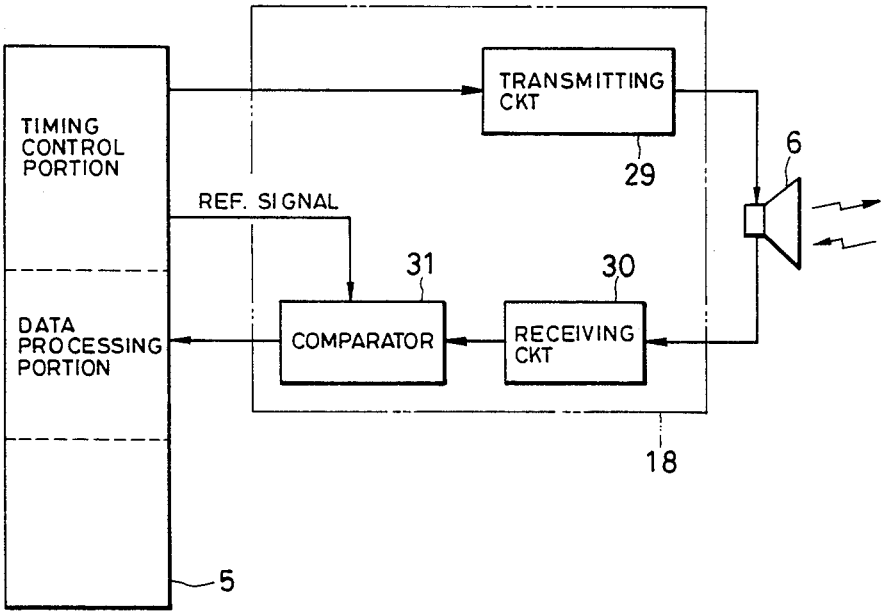
FIG. 7 is a block diagram showing a drive and detection circuit to be provided for drive of the ultrasonic sensor of FIG. 6 and reception of signals from the ultrasonic sensor.

A description will be made hereinbelow in terms of the distance-measuring sensor 6 and the drive and detection circuit 18 with reference to FIGS. 6 and 7. FIG. 6 is a cross-sectional view showing one example of ultrasonic sensor usable as the distance-measuring sensor 6. The ultrasonic sensor 6, as shown in FIG. 6, comprises a piezoelectric device 20, a conically shaped resonator 22 coupled through a coupling shaft 21 to the piezoelectric device 20, terminals 24 coupled through lead lines 23 to the piezoelectric device 20, a terminal plate 25 for fixedly securing the terminals 24, a case 26, a beam shaping plate 27 for covering an opening of the case 26 positioned so as to face the conically shaped resonator 22, and an acoustic absorption sheet 28 provided on the terminal plate 25. A detailed description thereof will be omitted because the arrangement thereof is disclosed in "National Technical Report" Vol. 29, pages 504 to 514, No. 3, 1983. The distance-measuring sensor 6 is not limited to the above-mentioned ultrasonic sensor, but other sensors such as infrared sensor are applicable thereto. FIG. 7 is a block diagram showing one example of arrangements of the drive and detection circuit 18. The drive and detection circutt 18 comprises a transmitting circuit 29 and a receiving circuit 30. The transmitting circuit 29 drives the distance-measuring sensor 6 in response to a timing control signal from the control section 5 and the receiving circuit 30 receives an output signal of the distance-measuring sensor 6 corresponding to the echo wave returning from the object 7. The output signal of the receiving circuit 30 is supplied to a comparator 31 where the output signal of the receiving circuit 30 is compared with a reference signal. When the level of the output signal thereof exceeds the level of the reference signal, the output signal thereof is latched and supplied to a data-processing portion of the control section 5. The control section 5 counts the time period from the transmission to the reception and calculates the distance to the table 8 or the object 7 on the basis of the propagating time of the ultrasonic wave and then to detect the position of the table 8 and the height of the object 7. The detection of the height of the object 7 allows discrimination of the kind of the object 7 even if the table 8 takes the same position. That is, at the time of the start of heating, the chou is lower in height and the bread is higher in height. Furthermore, since the condition of expansion of the object 7 can be detected, it is possible to determine the kind of the object 7 on the basis of the condition of the expansion.

Figure 8:
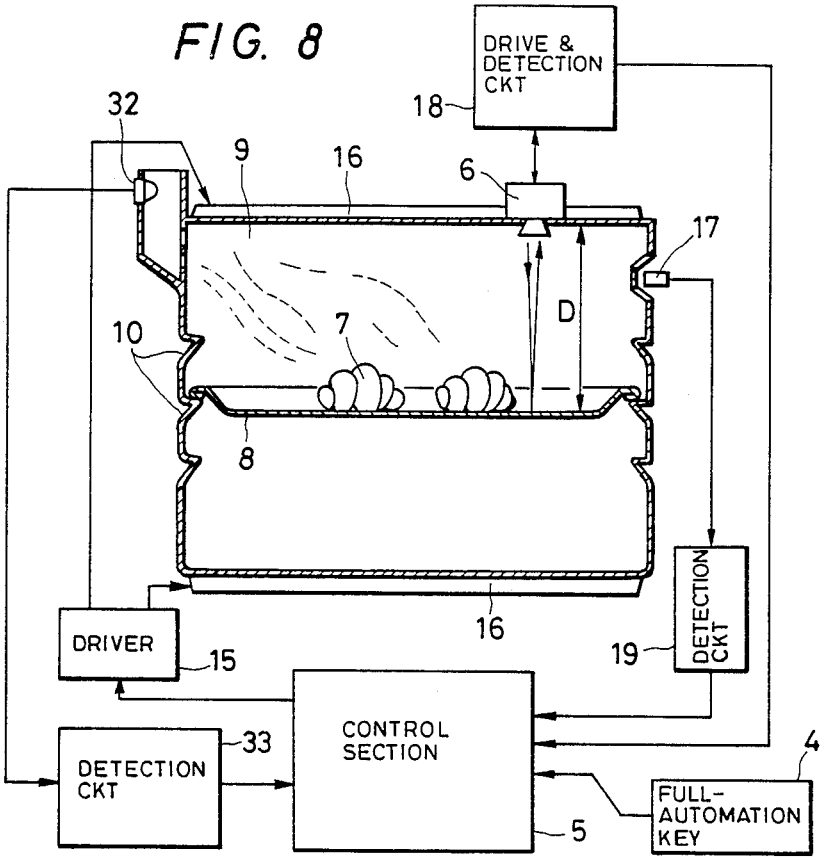
FIG. 8 is a block diagram showing an arrangement of an automatic heating appliance according to second embodiment of the present invention.
Figure 9:
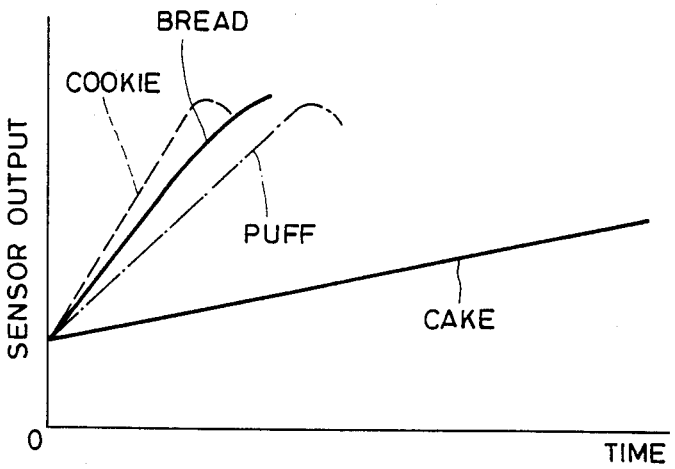
FIG. 9 is graphic illustration for describing variation of the generating state of gas in accordance with the kind of an object.

FIG. 8 is an illustration of an automatic heating appliance according to a second embodiment of the present invention which is arranged so that the class of an object to be heated is determined on the basis of the position of an object-mounting table and the generating state of vapor or gas from the object. Parts corresponding to those in FIG. 1 are marked with the same numerals and the description thereof will be omitted for brevity. In response to operation of a full-automation key 4, a control section 5 starts heating of an object 7 placed on a table 8 positioned by rack rails 10 arranged within a heating chamber 9. The heating causes generation of vapor or gas from the object 7. The generated vapor or gas is detected by a gas sensor 32 which is located at the side wall of the heating chamber 9. The gas sensor 32 may be a humidity sensor in this embodiment and the gas sensor 32 and the detection circuit 33 can be realized in accordance with the description in Japanese Patent Provisional Publication No. 51-134951, for example. The gas-generating information is supplied through a detection circuit 33 to the control section 5 to check the generating state of the gas or vapor. The control section 5 determines the class of the object 7 on the basis of the generating state thereof and the position of the table 8 which is measured by means of a distance-measuring sensor 6 and a drive and detection circuit 18. FIG. 9 is a time chart showing a method of determination of the class of the object 7, in which the vertical axis represents variation of the output of the sensor 32, i.e., absolute humidity, and the horizontal axis represents elapsed time. As understood from FIG. 9, the gas-generating state is varied in accordance with the kind of the object 7 and therefore the kind of the object 7 can be determined by detection of the gas-generating state even if the table 8 takes the same position. Accordingly, the control section 5 plots the outputs of the gas sensor 32 with respect to time and determines the kind of the object 7 in accordance with a curve formed by the plotting of the outputs. For example, even if the cooking is started as a cake in spite of the object 7 being a bread, since the kind of the object 7 can be determined in accordance with the gas-generating state, the cooking error can be removed by changing the heating temperature at the time of the determination of the kind of the object 7.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A heating appliance with a heating chamber, comprising:

heating means for heating an object to be heated which is encased within said heating chamber;

table means provided within said heating chamber, said object being placed on said table means;

rack means including plural pairs of supporting rails, which are symmetrically arranged up and down on inner side walls of said heating chamber and each pair of which are equal in height to each other, so that said table means is selectively placed on one of said plural pairs of supporting rails to allow it to take a desired height position within said heating chamber;

sensor means for measuring a distance from said sensor means to said table means or said object; and control means for controlling said heating means on the basis of the distance measured by said sensor means so as to heat said object in accordance with the position thereof within said heating chamber.

2. A heating appliance as claimed in claim 1, wherein said sensor means comprises an ultrasonic sensor for transmitting an ultrasonic wave toward said table means of said object and receiving an echo signal returning therefrom.

3. A heating appliance as claimed in claim 2, wherein said ultrasonic sensor has a circuit for comparing the echo signal with a reference and supplies to said control means the echo signal exceeding said reference in level.

4. A heating appliance as claimed in claim 1, further comprising indicator means coupled to said control means for indicating information for a user of said heating appliance, and wherein said control means determines the kind of said object in accordance with the measured distance and indicates the determined kind of said object on said indicator means.

5. A heating appliance as claimed in claim 1, further comprising a temperature sensor for sensing a temperature within said heating chamber, and wherein said control means controls the temperature within said heating chamber on the basis of the output of said temperature sensor.

6. A heating appliance as claimed in claim 1, wherein said heating means comprises upper and lower heaters provided at upper and lower portions of said heating chamber and said control means controls the distribution of power supply to said upper and lower heaters in accordance with the measured distance to said table means or said object.

7. A heating appliance as claimed in claim 1, wherein said sensor means successively measures the distance to said object and said control means controls said heating means in accordance with variation of the distance.

8. A heating appliance with a heating chamber, comprising:

heating means for heating an object to be heated which is encased within said heating chamber;

table means provided within said heating chamber, said object being placed on said table means;

rack means including plural pairs of supporting rails, which are symmetrically arranged up and down on inner side walls of said heating chamber and each pair of which are equal in height to each other, so that said table means is selectively placed on one of said plural pairs of supporting rails to allow it to take a desired height position within said heating chamber;

first sensor means for measuring a distance from said sensor means to said table means or said object;

second sensor means for sensing a vapor and/or gas generated from said object; and control means for controlling said heating means on the basis of the distance measured by said sensor means and the generation state of said gas sensed by said second sensor means so as to heat said object within said heating chamber and the sensed gas generation state.

9. A heating appliance as claimed in claim 8, wherein said sensor means comprises an ultrasonic sensor for transmitting an ultrasonic wave toward said table means or said object and receiving an echo signal returning therefrom.

10. A heating appliance as claimed in claim 9, wherein said ultrasonic sensor has a circuit for comparing the echo signal with a reference and supplies to said control means the echo signal exceeding said reference in level.

11. A heating appliance as claimed in claim 8, further comprising indicator means coupled to said control means for indicating information for a user of said heating appliance, and wherein said control means determines the kind of said object in accordance with the measured distance and indicates the determined kind of said object on said indicator means.

12. A heating appliance as claimed in claim 8, wherein said second sensor means comprises a humidity sensor for measuring a humidity within said heating chamber.

13. A heating appliance as claimed in claim 8, wherein said heating means comprises upper and lower heaters provided at upper and lower portions of said heating chamber and said control means controls the distribution of power supply to said upper and lower heaters in accordance with the measured distance to said table means or said object.

14. A heating appliance as claimed in claim 8, wherein said sensor means successively measures the distance to said object and said control means controls said heating means in accordance with variation of the distance.

* * * * *